United States Patent [19]

Rettew

[11] 4,267,671

[45] May 19, 1981

[54] POSITIONING OF AN ABRASIVE BELT ON A GRINDING MACHINE

[75] Inventor: Richard Rettew, Newmanstown, Pa.

[73] Assignee: Contraves Goerz Corporation, Pittsburgh, Pa.

[21] Appl. No.: 936,349

[22] Filed: Aug. 24, 1978

[51] Int. Cl.[3] ..... B24B 21/00; B24B 21/18

[52] U.S. Cl. ..... 51/135 BT; 51/142; 51/143; 51/148

[58] Field of Search ..... 51/135 R, 142, 143, 51/170 EB, 148, 135 BT, 356, 92 R; 74/242.16, 242.8, 230.01, 230.5

[56] References Cited

U.S. PATENT DOCUMENTS

| | | | |
|---|---|---|---|
| 1,628,531 | 5/1927 | Carlson | 51/142 |
| 1,709,171 | 4/1929 | Holmes | 51/135 R |
| 2,378,066 | 6/1945 | DeYoung | 51/92 R |
| 2,396,775 | 3/1946 | DeYoung | 51/92 R |
| 2,423,737 | 7/1947 | Tavano | 51/135 R |
| 2,565,223 | 8/1951 | Gentzel | 51/170 EB |
| 2,837,877 | 6/1958 | Andrus | 51/143 |
| 3,354,588 | 11/1967 | Roehrig | 51/148 |
| 3,416,384 | 12/1968 | Maca | 74/242.16 |
| 3,510,988 | 5/1970 | Mason | 51/148 |
| 3,577,684 | 5/1971 | Jakimcius | 51/135 BT |

FOREIGN PATENT DOCUMENTS

| | | | |
|---|---|---|---|
| 536145 | 1/1957 | Canada | 51/170 EB |
| 280936 | 5/1952 | Switzerland | 74/230.01 |

*Primary Examiner*—Harold D. Whitehead
*Assistant Examiner*—K. Bradford Adolphson
*Attorney, Agent, or Firm*—Robert D. Yeager

[57] ABSTRACT

A belt grinding machine wherein the belt is maintained at a selected position on the drive and idler pulleys and the drive and idler pulleys are supported from a column which is oscillated relative to the work piece holder. The drive pulley or contact wheel is directly driven by a drive motor which is also supported from the oscillating column. The column is supported for movement transverse to an elongated bed which supports a reciprocating table. The reciprocating table holds the article to be ground. The speed and distance of movement of the table and column are variable. The grinding belt is positioned automatically, through photo sensors and hydraulic controls, on the idler and drive pulleys. The idler pulley is supported by bearings from an eccentric spindle which can be rotated in steps by a hydraulic cylinder to change slightly the idler pulley alignment for proper steering of the belt. When the belt moves from its desired position, it is slowly moved back to the desired location. During operation the eccentric spindle is moved slightly and after a slight time delay the belt position is again sensed to determine if further adjustment is necessary.

12 Claims, 20 Drawing Figures

POSITIONING OF AN ABRASIVE BELT ON A GRINDING MACHINE

CROSS REFERENCES TO RELATED APPLICATIONS

This application is related to U.S. patent application Ser. No. 936,621, filed Aug. 24, 1978.

BACKGROUND OF THE INVENTION

1. Field of the Invention

This invention relates to a material removing machine and more particularly to a high speed high pressure belt grinder.

2. Description of the Prior Art

Numerous metal removal apparatus and methods are disclosed in the prior art. Milling machines, vertical spindle grinders, double disc grinders, face broches, and planars have been utilized for removing material from flat planar surfaces. The prior art also includes numerous belt grinding machines for material removal.

U.S. Pat. No. 3,668,814 issued to C. T. Freerks recognizes that with high pressure belt grinder, above a predetermined minimum pressure, metal is removed so swiftly that a large percentage of the heat generated is removed by the chips. This results in a temperature rise of a work piece which is greatly reduced as compared with the temperature rise of the work piece when it is ground at pressures below the predetermined minimum pressure, so that damage to the part and to the abrasive belt is minimized.

U.S. Pat. No. 3,132,451 to J. A. Kline recognizes some of the problems such as clouding, dirt, or the like with respect to photoelectric detection. Kline describes an air pressure sensitive system which may not be satisfactory at high belt speeds due to the boundry layer of air which causes false pressure differentials.

Some other prior art patents such as U.S. Pat. No. 2,813,383 issued to Pendergast tilt the idler pulley severly to achieve belt shift, and this may lead to premature belt failure.

It has been recognized that it is desirable to move the grinding belt relative to the work piece for uniform belt wear. This has typically been achieved in the prior art by moving the belt back and forth along the contact and idler pulley. The idler pulley can be shifted to cause this back and forth movement of the grinding belt relative to the contact pulley and idler pulley. I recognized that this type of belt shifting causes premature belt failure since first all the tension is applied to one edge of the belt then the tension is transferred to the other belt edge. This continues as long as the belt is moved back and forth. In my belt grinder I maintain a relatively even tension over the whole belt as compared with other belt tracking systems.

The following U.S. Patents are exemplary of prior art belt grinders: (1) U.S. Pat. No. 2,813,382; (2) U.S. Pat. No. 3,132,451; (3) U.S. Pat. No. 3,229,424; (4) U.S. Pat. No. 3,325,947; (5) U.S. Pat. No, 3,394,501; (6) U.S. Pat. No. 3,510,988; (7) U.S. Pat. No. 3,524,285; (8) U.S. Pat. No. 3,739,535; and, (9) U.S. Pat. No. 3,908,316.

SUMMARY OF THE INVENTION

This invention discloses a high speed, high pressure coated abrasive grinding machine having means for steering the belt in a relatively fixed location on the drive and idler pulleys and means for oscillating the drive and idler pulleys relative to the work piece. The drive and idler pulleys are supported from a column which is oscillated relative to the items to be ground. Photo electric sensors and a belt centering device are utilized for steering the belt to a selected position on the idler and drive pulleys. A column is then oscillated so that the belt moves across the work piece to obtain uniform belt wear.

The idler pulley is supported for rotation around an eccentric spindle which can be positioned for the desired belt steering. Photo sensors utilizing a modulated electric light source are used for detecting the position of the coated abrasive grinding belt edge. When the edge of the coated abrasive belt moves out of the desired position, the photo sensor, through appropriate interconnections, activates a hydraulic cylinder which rotates the idler pulley's eccentric spindle to steer the belt back to the desired position.

The disclosed apparatus is constructed for slow movement of the grinding belt across the idler and contact wheel pulleys to enhance belt life. During operation the eccentric shaft is moved only slightly to steer the coated abrasive grinding belt. After the eccentric pulley is adjusted slightly there is a time delay before another adjustment will be made. If after the time delay the coated abrasive belt is still not in the desired position the eccentric spindle will again be rotated to properly steer the belt. This continues until the belt is at the desired position.

A pair of adjustable limits are provided for setting the distance through which the column will oscillate. The column is oscillated by a hydraulic cylinder. Appropriate flow control valves are provided in the ports to the double acting hydraulic cylinder for controlling the speed of oscillation of the column. Thus the speed of oscillation and the distance of oscillation of the coated abrasive belt relative to the reciprocating table are positively controlled and are adjustable.

The oscillating column is supported from a fixed base. The fixed base is securely attached to an elongated bed. The work piece moves on the elongated bed. The elongated bed can include a reciprocating table for holding a work piece. Various columns can be arranged with various beds for processing different items.

The drive motor for the drive pulley is also supported from the column for movement therewith. By maintaining the belt at a fixed position, on the idler and drive pulleys, and oscillating the column uniform belt wear is obtained and a much longer belt life results. Belt life is an especially critical item since over the life of the machine this represents a major cost of operating a belt grinding machine.

It is an object of this invention to teach a high speed, high pressure coated abrasive belt grinding machine wherein the belt is steered and maintained in a straight line on the contact wheel and idler pulley.

It is another object of this invention to teach a high speed, high pressure coated abrasive belt grinding machine wherein the belt is maintained at a selected position on the idler and drive pulleys and wherein the idler and drive pulleys are oscillated relative to the work piece.

It is another object of this invention to teach a belt grinding machine having a vertical column which oscillates relative to the work holder with the idler pulley, drive pulley, and coated abrasive grinding belt supported from the oscillating column.

It is yet another object of this invention to teach a belt grinding machine wherein the belt is maintained at a selected position on the idler and drive pulleys which are supported from an oscillating column wherein the speed and distance of oscillation of the column are adjustable.

It is yet another object of this invention to teach a belt grinding machine wherein the idler pulley is supported on an eccentric shaft which is positionable by a hydraulic cylinder responsive to photo detectors which sense the edge position of the grinding belt to maintain the grinding belt at a desired position.

BRIEF DESCRIPTION OF THE DRAWINGS

For a better understanding of the invention, reference may be had to the preferred embodiment exemplary of the invention shown in the accompanying drawings in which.

DETAILED DESCRIPTION OF THE PREFERRED EMBODIMENTS

Figure 1:
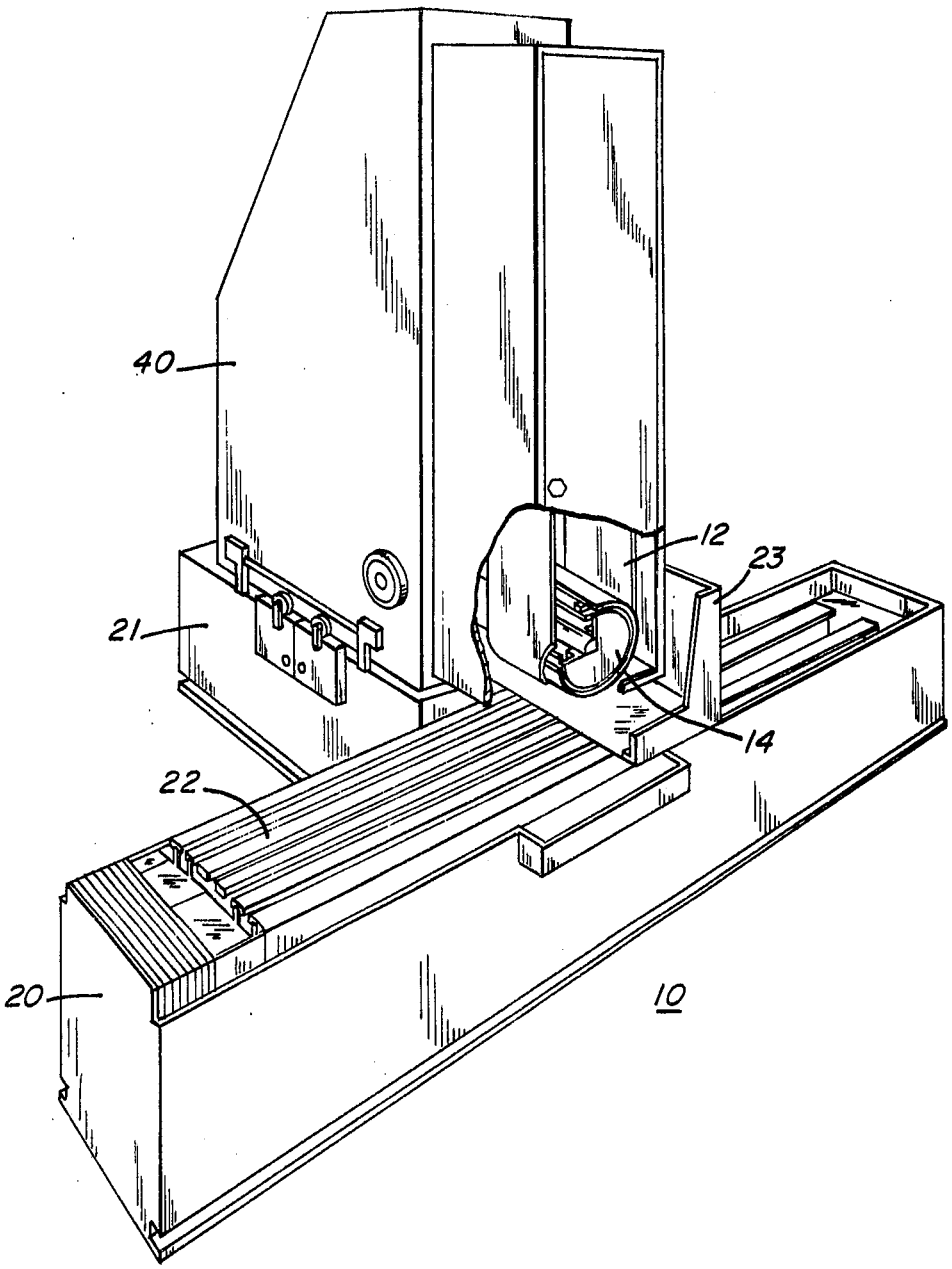
FIG. 1 is a perspective view of a high speed, high pressure belt grinding machine constructed according to the teaching of the present invention.

Referring now to the drawings and FIGS. 1 through 4 in particular there is shown a belt grinding machine 10 constructed according to the teaching of the present invention. The disclosed machine 10 provides coated abrasive machining and utilizes an endless belt 12 covered with a mineral grain to grind planar surfaces. Belt grinding machine 10 provides for high speed, high pressure stock removal. The coated abrasive belt 12 is disposed around a contact wheel 14 and an idler wheel 16. Typical belt speeds for the disclosed grinder 10 are around 8,000 surface feet per minute. No outboard support is required for contact wheel 14. A fixed bed 20 is provided on which a 16 inch by 48 inch reciprocating table 22 is supported on roundway roller bearings. Table 22 is constructed to hold the work piece. A fixed base 21 extends at a right angle from bed 20. A vertical column 40 is slidably supported from base 21. Column 40 oscillates back and forth with respect to reciprocating table 22 along base 21. Reciprocating column 40 moves at a right angle to the longitudinal axis of bed 20 on base 21. Base 21 is securely fastened to bed 20. An optical electrical tracking system is provided for maintaining belt 12 at a fixed location on drive pulley 14 and idler pulley 16. This is unlike most prior art grinding machines on which the belt is purposely caused to oscillate on the drive and idler pulley. In grinding machine 10 belt 12 is maintained at a fixed position on pulleys 14, 16 and, column 40 is oscillated back and forth a selected distance at a selected speed.

The speed and distance of movement of column 40 are variable. Likewise the speed and distance of movement of reciprocating table 22 are variable. The work piece is attached to table 22 and then the contact wheel 14 is lowered so that the coated abrasive belt 12 engages the work piece and removes the desired amount of material. The typical belt speed of approximately 8000 surface feet per minute, coupled with the feed rate of 25 to 35 feet per minute, generates temperatures in the contact area that approach the melting point of the material abraded. These temperatures aid the machining process by reducing friction and correspondingly increase belt life. U.S. Pat. No. 3,668,814, issued to C. T. Freerks pointed out that with high pressure grinding above a predetermined minimum pressure, metal is removed so swiftly that a large percentage of the heat generated is removed with the chips. In my invention any heat build up in the work piece is minimal since typically over 90% of the energy released is removed by the swarf.

Base 21 provides support for column 40. Base 21 encloses column 40 oscillating mechanism. Base 21 is securely fastened to bed 20 by suitable means such as bolting. The disclosed grinding machine 10 is of a modular construction so that various types of bases can be connected to various types of beds to provide for metal removal on a wide variety of products. For example, reciprocating table 22 can be removed and replaced with a through conveying system and multiple columns can be mounted from bed 20. Thus a coarse and fine cut could be made on a single pass of the item through the grinder.

Figure 2:
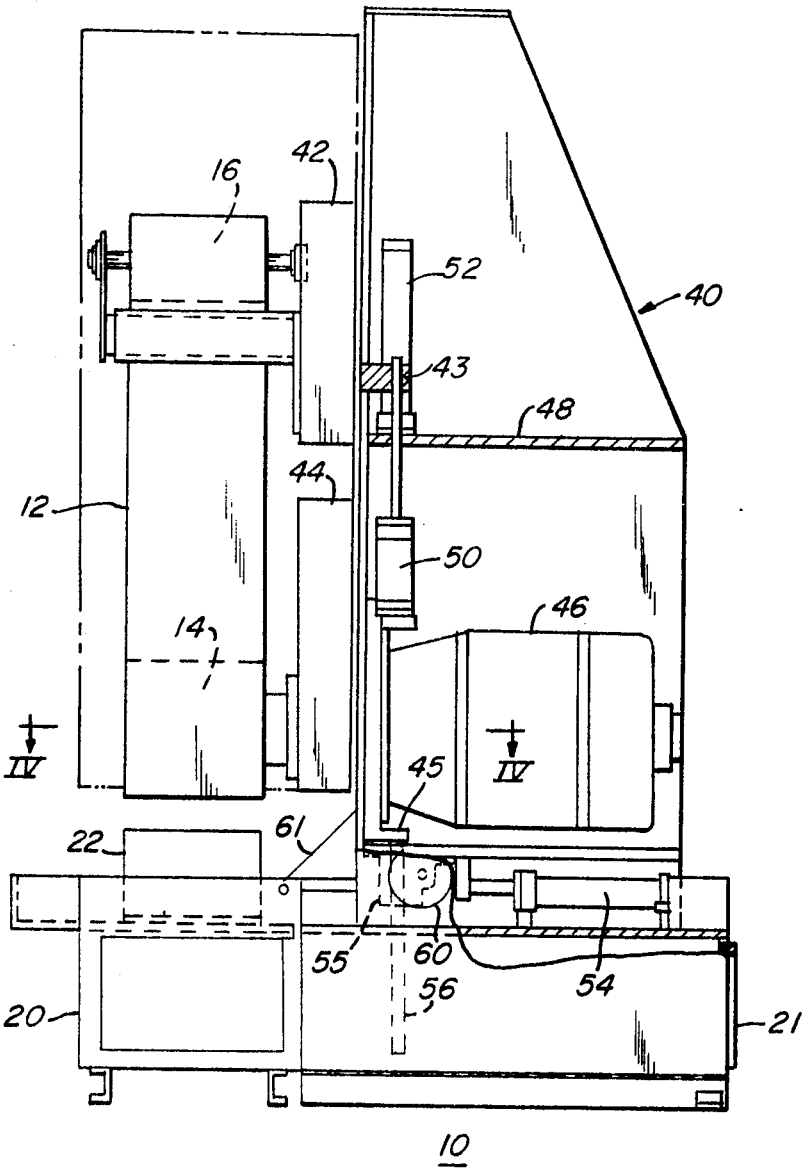
FIG. 2 is an end view of the grinding machine shown in FIG. 1 with certain positions not shown for clarity.
Figure 3:
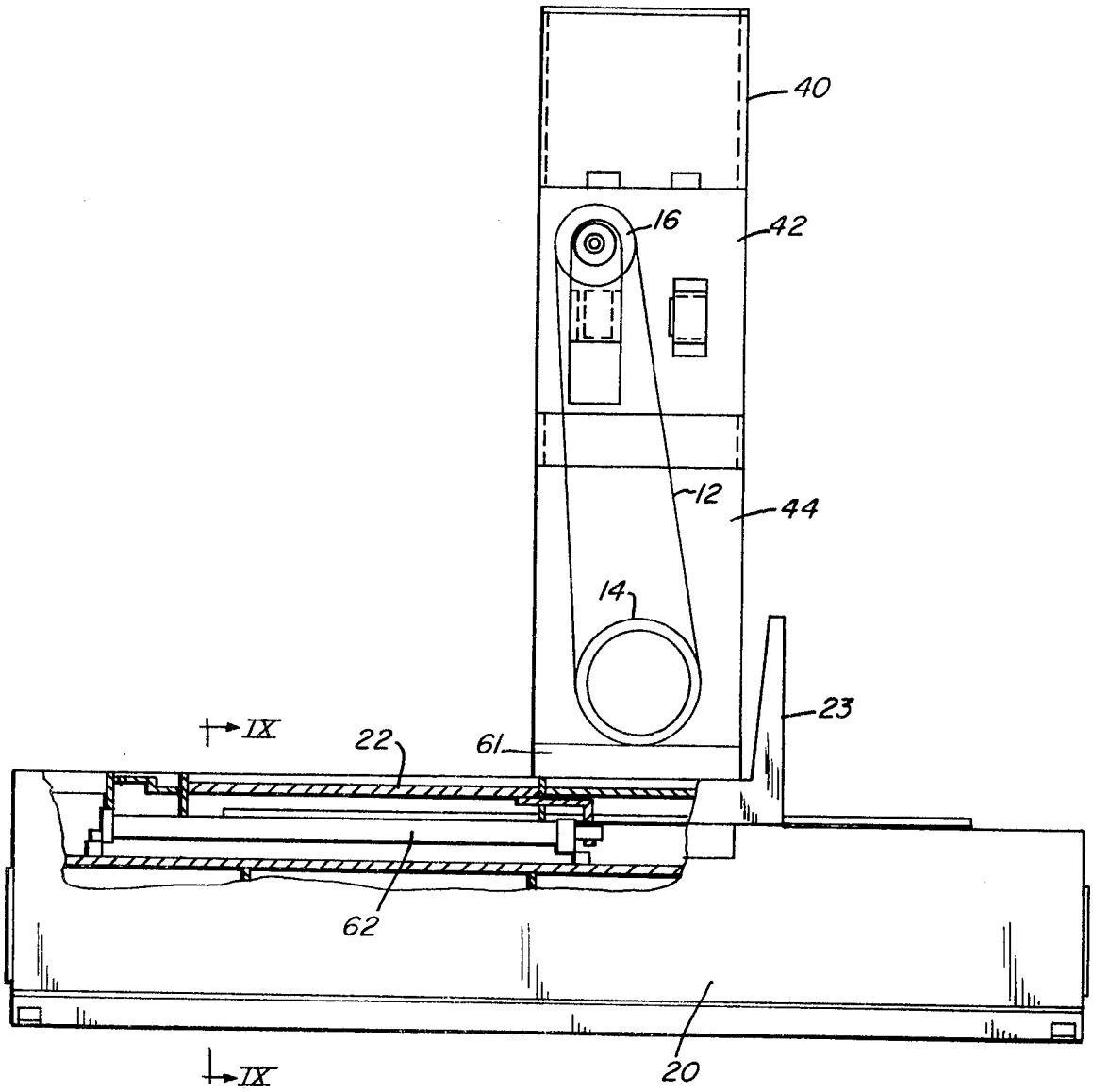
FIG. 3 is a front view of the grinding machine shown in FIG. 1 with portions removed for clarity.

Referring now to FIGS. 2 and 3 there is shown grinding machine 10 constructed according to the present invention with some items deleted or shown schematically for clarity. Column 40, which reciprocates on base 21 and moves belt 12 transverse to table 22, supports the drive assembly for contact wheel 14. An upper slide 42 and a lower slide 44 are slidably supported from vertical column 40. Rollway bearings as manufactured by Thomson Industries, Inc., Manhasset, N.Y. 11030, are utilized for supporting the upper slide 42 and the lower slide 44 from vertical column 40. Contact wheel 14, whose construction will later be described in detail, is direct driven by drive motor 46. In the embodiment shown drive motor 46 is a 125 horse power, 1750 rpm, 3 phase, 60 hertz, 230/460 volt induction motor. Drive motor 46 is flanged mounted to a rear portion of lower slide 44. Column 40, which is mounted for sliding movement on base 21, is a fabricated steel unit approximately 105 inches in height. Support plate 48 is disposed horizontally within column 40. A pair of pneumatic cylinders 50 are disposed between the upper slide 42 and the lower slide 44. Openings are formed in plate 48 through which the operating rods of pneumatic cylinders 50 extend to connect to rear blocks 43 formed integral with upper slide 42. The pneumatic cylinders 50 bias slides 42, 44 apart to provide tension on coated abrasive belt 12. Pneumatic cylinders 50 are horizontally spaced apart on lower slide 44.

The grinding head assembly thus consists of the upper slide 42, lower slide 44, drive motor 46, contact wheel 14, idler wheel 16, belt 12, and the various other components supported therefrom. Hydraulic cylinder 52 is secured to support plate 48 between the operating rods of pneumatic cylinders 50. The operating rod for hydraulic cylinder 52 is connected to a bracket secured to lower slide 44. Hydraulic cylinder 52 is used to move the grinding head assembly towards and away from table 22 which contains the work piece. The pressure applied to hydraulic cylinder 52 for moving slide 44 downward is regulated so that motor 46 is not overloaded when belt 12 contacts the work piece. Idler pulley 16, which has a 10 inch outer diameter, is supported by upper slide 42 and is offset to achieve 100° of belt contact on the contact wheel 14 after the midpoint in the direction of rotation. Constructing the idler pulley 16 with a diameter smaller than the contact wheel 14 causes more than 180° of contact between the belt 12 and the contact wheel 14. Offsetting the idler pulley 16 from vertical alignment with the contact wheel 14 increases the arc of contact between the belt 12 and contact wheel 14 after the point of engagement with the work piece. This provides increased surface for pulling the belt through the area of contact with the work piece. The idler pulley 16, contact wheel 14 and belt 12 are enclosed in an internally locked housing fabricated from $\frac{1}{8}$" sheet metal.

Machine base 21 is 26 inches wide, 51 inches deep and $25\frac{1}{4}$ inches high. Base 21 encloses the column oscillating mechanism. Column oscillation hydraulic cylinder 54 is secured between column 40 and base 21. The housing of hydraulic cylinder 54 is connected to base 21 and the operating rod for hydraulic cylinder 54 is connected to column 40. Hydraulic cylinder 54 has a 12 inch stroke. Column 40 is supported from base 21 on roundway roller bearings as manufactured by Thomson Industries, Inc., Manhasset, N.Y. 11030. Column 40 thus follows the movement of the operating rod from hydraulic cylinders 54. The length of stroke and speed of operation of hydraulic cylinder 54 are variable.

Figure 10:
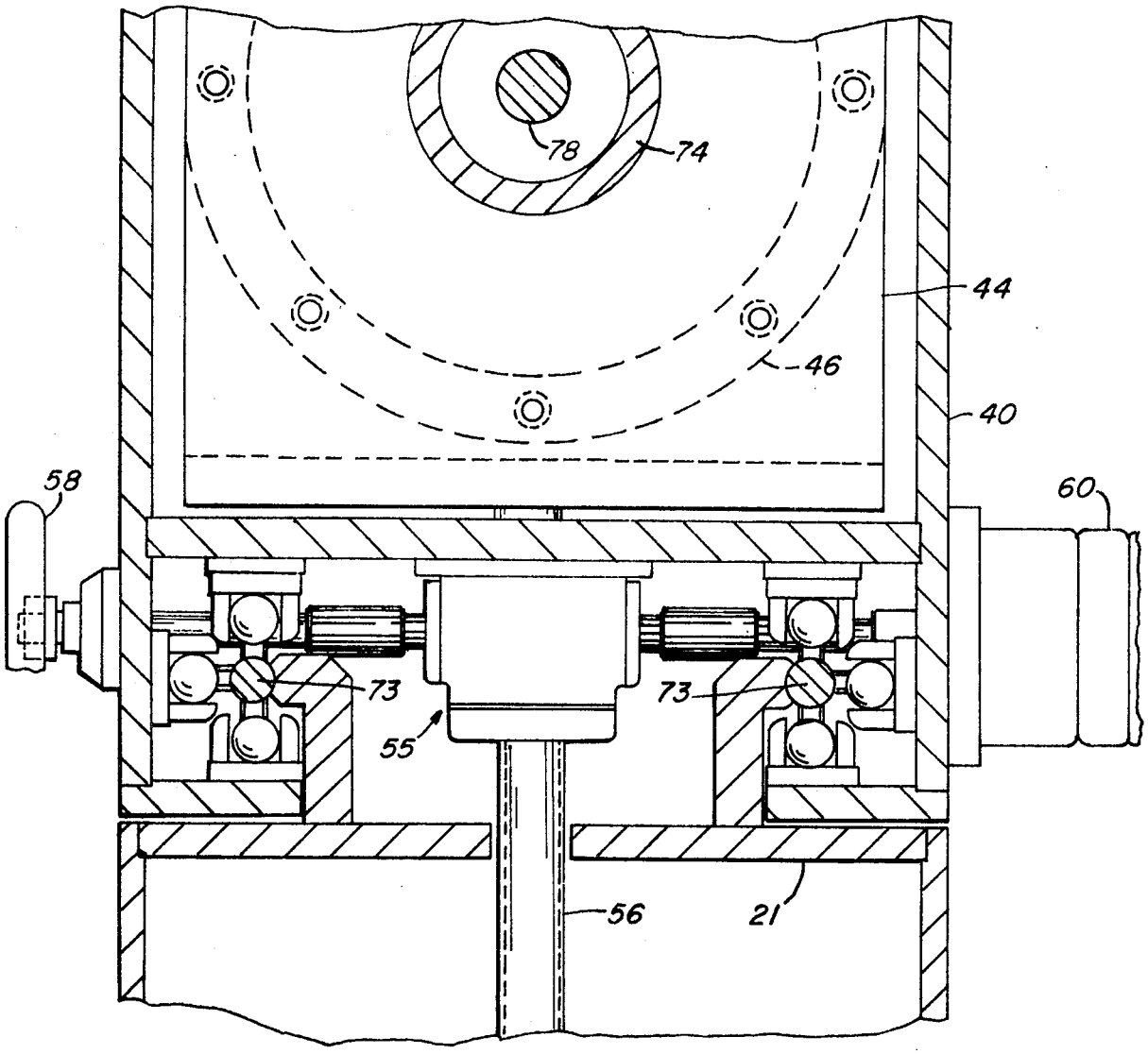
FIG. 10 is a sectional view of the portion of the base and vertical column assembly, illustrating the adjustable fixed stop including the manual and electrical adjustments along the line X—X of FIG. 11.

An adjustable fixed stop 55 is provided on base 21 for limiting downward movement of the grinding head assembly. The adjustable fixed stop 55 is formed from a 10-ton screw jack. The adjustable stop utilizes a threaded rod 56 which can be positioned at a desired height to limit downward travel of lower slide 44. Lower slide 44 includes a rearward extending flange portion 45 which is positioned to engage the top of threaded rod 56 at some downward position. As seen in FIG. 10, the height at which threaded rod 56 is set determines how far the contact wheel 14 can move towards work table 22. The height of threaded rod 56 can be set with a manual hand crank 58 or with an electric positioning drive 60. Setting stop 56 thus determines how much material is removed from the work piece. The setting of fixed stop 56 is not affected by positioning of the grinding head assembly. Thus the grinding head assembly can be set to move down in increments until it contacts fixed stop 56 at which point its downward movement will be stopped.

A sheet of flexible material 61 is connected between base 20 and column 40 to prevent material removed during grinding from getting into the oscillating assembly. Bed 20 supports reciprocating work table 22 with a guard 23 provided on one end to catch or deflect griding swarf. Work table 22 is machined from cast iron and has a 16 inch by 48 inch work area with Tee slots formed therein. The table 22 surface is 36 inches above the floor. Bed 20 is 135 inches long and houses the hydraulic table reciprocating cylinder 62. Hydraulic cylinder 62 is disposed between a fixed portion of bed 20 and table 22 and as the operating rod of cylinder 62 moves between its extended and retracted position table 22 is also moved. Table 22 is supported on Thompson rollway bearings from bed 20. Table 22 thus follows the movement of the operating rod of the table reciprocating cylinder 62. The distance of movement and the speed of operation of hydraulic cylinder 62 can be varied. Sludge collection troughs are provided in bed 20 to provide for drainage of lubricant or coolant for wet grinding or collecting applications.

Figure 4:
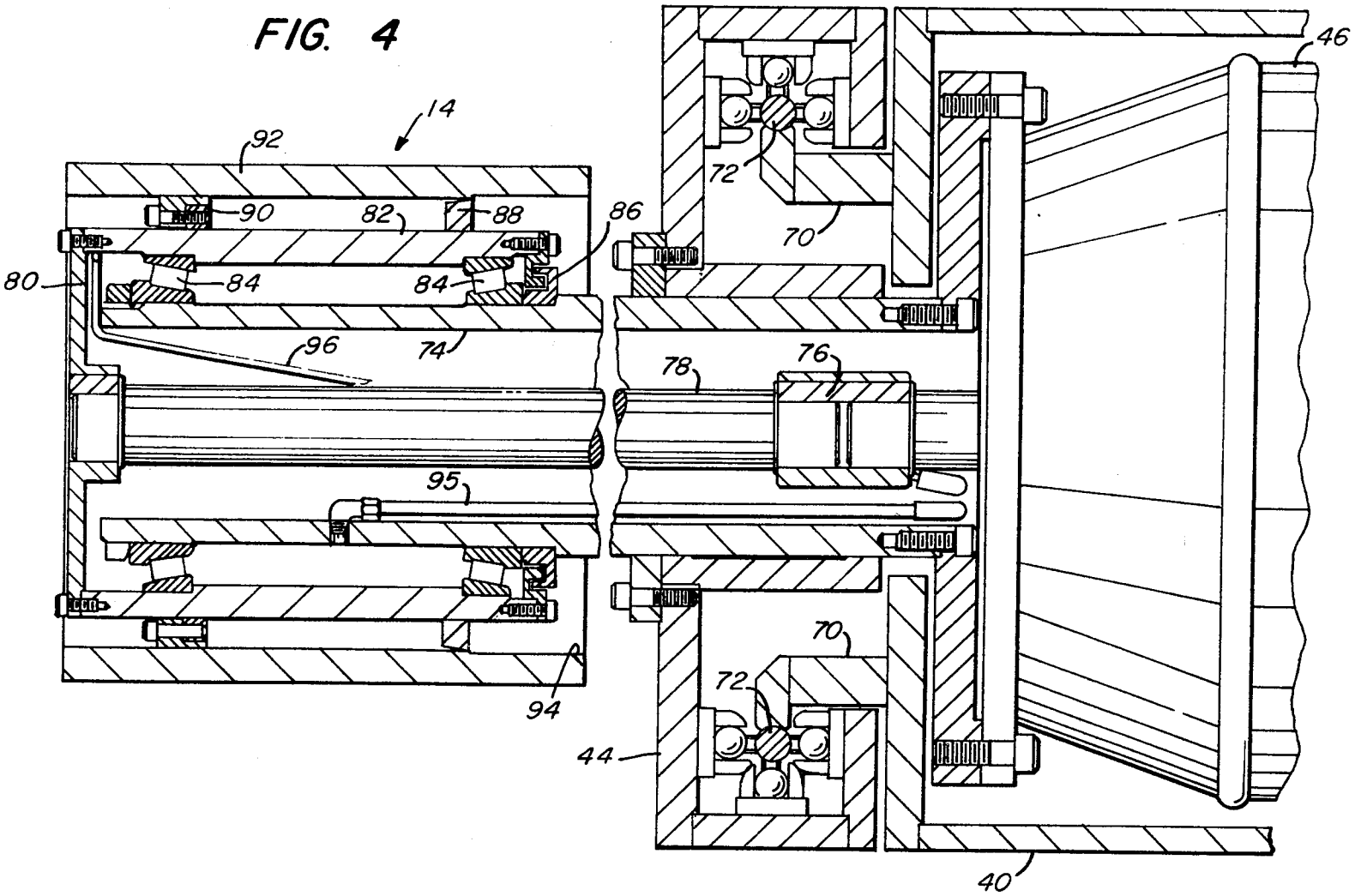
FIG. 4 is a view of the grinding machine shown in FIG. 2 along the lines IV—IV showing the contact wheel slide assembly including the direct drive electric motor.

Referring now to FIG. 4 there is shown a detailed view partially in section of contact wheel 14 and lower slide 44. Projections 70 extend out from column 40 and have hardened and ground shafts 72 attached to the ends thereof. Elongated shaft 72 extends in a vertical direction and provides the guide and support for upper slide 42 and lower slide 44. Slides 42, 44 are supported on Thompson Single Roundway Bearing and Mounting Blocks No. RW-16S from shafts 72. Electric motor 46, which is a type D, is flange mounted to a rear portion of slide 44. A hollow drive pulley spindle 74, which is a tubular shaped member, is securely fastened to lower slide 44. Hollow spindle 74 is longitudinally aligned and concentric with the shaft of motor 46. Motor 46 is coupled by shaft sleeve 76 to drive shaft 78. Drive shaft 78 extends through hollow tubular spindle 74. A circular shaft plate 80 is connected to the outer end of drive shaft 78, which extends from hollow spindle 74. An inner drive pulley 82 extends from the periphery of circular shaft plate 80 towards drive motor 46. Inner drive pulley or hub 82 partially surrounds hollow spindle 74. Inner drive hub 82 is supported by a pair of tapered roller bearings 84 from the outer diameter of tubular spindle 74. A seal 86 is provided on the free end of inner hub 82 to provide a seal between inner hub 82 and the outer diameter of hollow spindle 74. Hollow spindle 74 is constructed to take the load applied when grinding an article without undue deflection.

Annular projections 88 and 90 are provided around inner hub 82. Drive pulley 92 which preferably has a 16 to 20 inch outer diameter fits over and is connected to inner drive hub 82. Fasteners are provided for connecting outer drive pulley 92 to annular rings 90 so that inner drive hub 82 and outer pulley 92 rotate as a unit. Annular ring 88 is formed with a slight taper and the inner end of drive pulley 92 has an undercut 94 so that when the fasteners are removed, drive pulley 92 can easily be removed from inner hub 82 without disturbing the bearings 84. The relatively rigid tubular spindle 74 which extends within drive pulley 92 provides support and prevents damage to the motor bearings. The direct drive shaft from motor 46 provides no support for contact pulley 92. This disclosed construction allows the elimination of an outboard support for the contact wheel assembly 14. The load on the drive pulley 92 is divided equally between the two tapered roller bearings 84. For a grinding machine it is necessary that the machine be able to withstand the applied pressure and still maintain accuracy. Having the bearings 84 sealed within the inner hub 82 prevents them being damaged by operating personnel when the contact wheel 92 is removed or changed. Preferably contact wheel 92 has a 16 inch to 18 inch outer diameter with a steel or rubber banded outer surface. Various other types of contact wheels 92 can be provided when desired.

Hydraulic fluids for cooling and lubricating bearings 84 are provided through tube 95 which extends within hollow spindle 74. If the bearings 84 were not cooled, they would go through a large temperature change and since the bearings are relatively large they would go through a large tolerance change and this would affect the machine accuracy. If the bearings temperature change was too great the bearings could become loose and give significantly less accurate operation. The hydraulic cooling and lubricating is provided from the same hydraulic supply which operates the various hydraulic cylinders on the machine. The hydraulic cooling is helpful in maintaining a given temperature change throughout the sealed portion of the pulley assembly 14 without changing the tolerance. The hydraulic cooling of bearings 84 also provides for long life.

Outboard support bearings for the contact wheel are commonly used on prior art belt grinders. Eliminating the outboard support bearing for the contact wheel 14 simplifies belt replacement and changing of the contact wheel. A return tube 96 is provided for returning oil to the hydraulic supply. A constant flow of oil is provided by force feeding oil through line 95 to the location of bearings 84. The pumped oil finds its way to the area where it can be picked up and returned through tube 96.

As oil enters the sealed rotating drive hub 82 it is forced against the inner diameter by centrifugal force. This area partially fills with oil during operation. Tube 96, which is stationary, has an opening facing against the direction the oil will rotate within drive hub 82. The position of the inlet opening in tube 96 will determine the depth of oil in the rotating drive hub 82. The oil within hub 82 balances the contact wheel assembly 14 and this provides for smooth operation. If desired tube 96 can be oriented with its intake opening at the bottom of drive hub 82. A vacuum pump can also be provided for drawing the oil out of drive hub 82.

Figure 5:
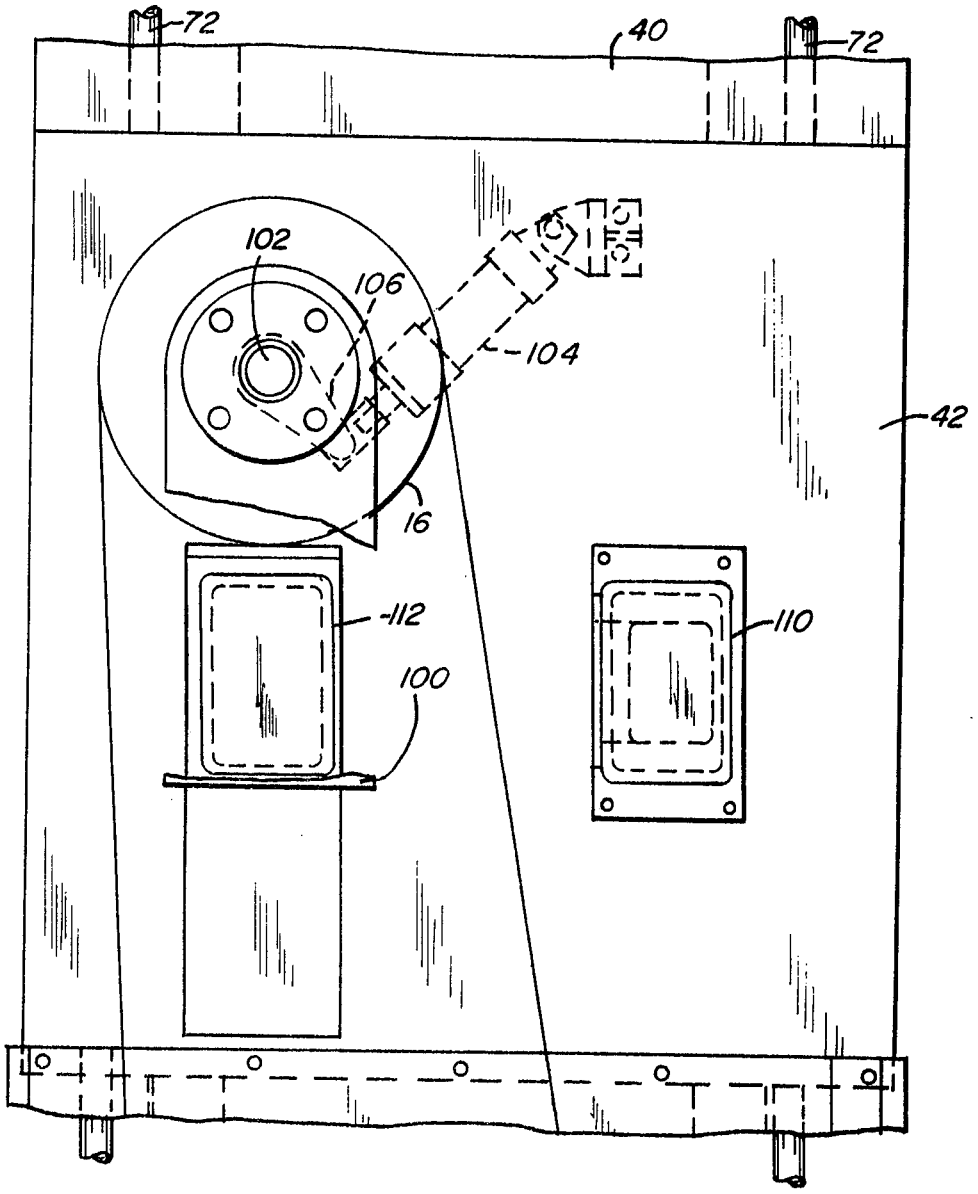
FIG. 5 is a front view of a portion of the grinding machine shown in FIG. 1 showing the idler wheel slide assembly.
Figure 6:
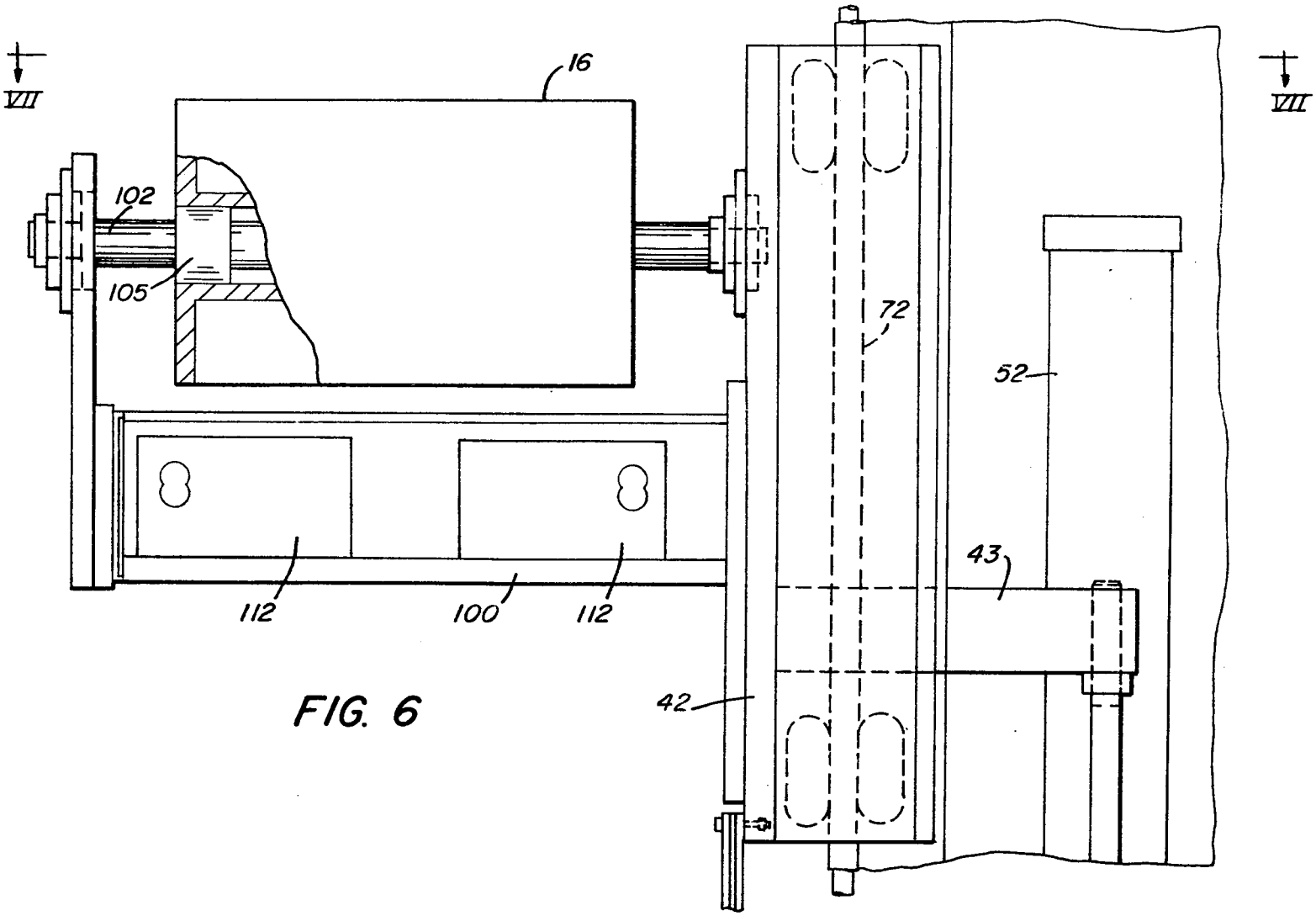
FIG. 6 is a side view of the portion of the grinding machine shown in FIG. 5, with portions broken away for clarity.
Figure 7:
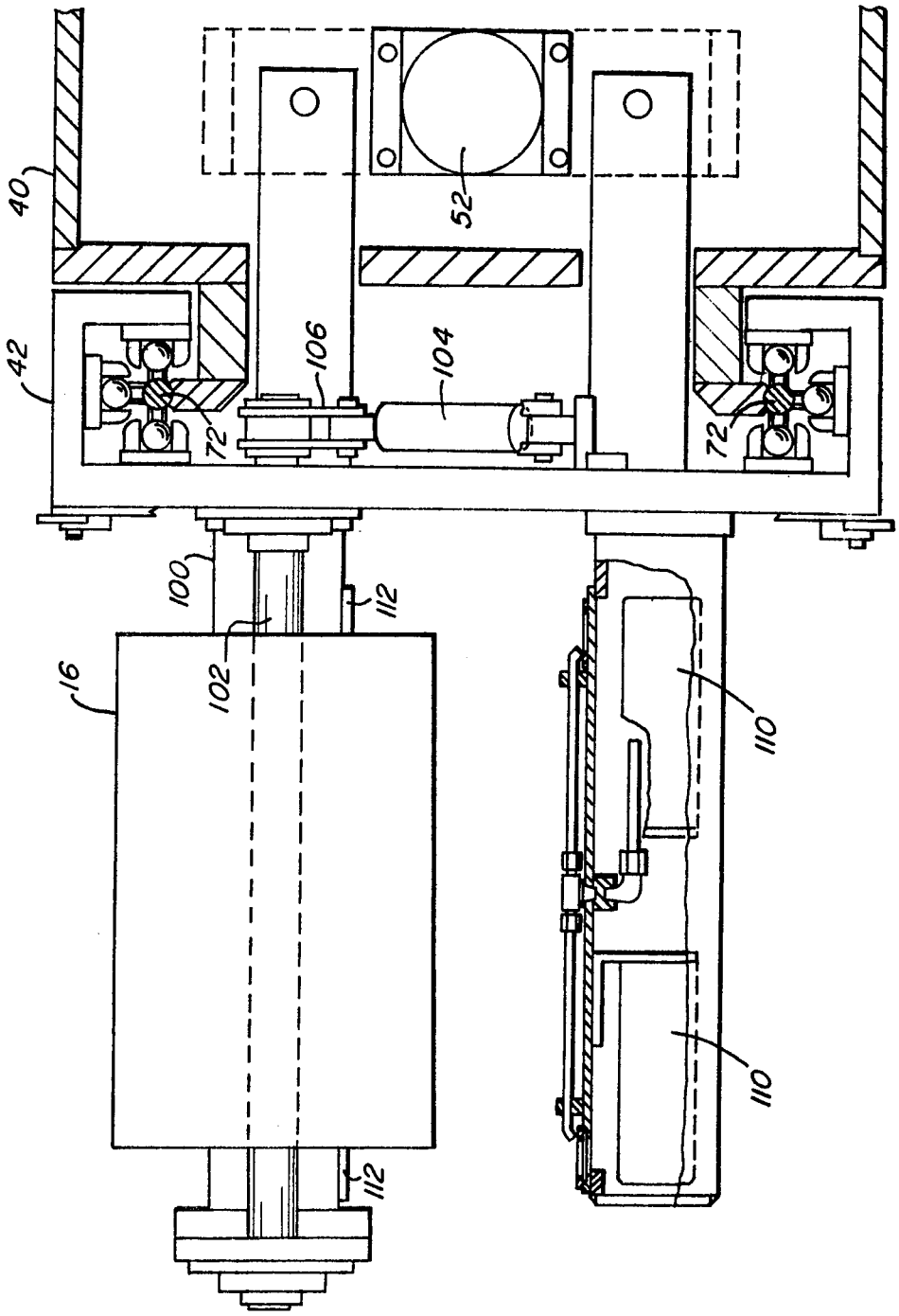
FIG. 7 is a top view in FIG. 6 along the line VII—VII.

Referring now to FIGS. 5, 6 and 7, there is shown a more detailed view of a portion of the vertical column 40, illustrating the idler pulley 16 and the electro optical tracking devices. The upper slide 42 is supported from ground and hardened vertically extending rods 72 which are connected to the structure of vertical column 40. Idler pulley 16 is 10 inches in diameter and is offset to achieve 100° of belt contact on the pulling side of contact wheel 14. A fabricated bracket 100 provides an outboard idler pulley support. Idler pulley 16 is supported at its ends by bearings 105 (one of which is shown in FIG. 6) for rotation around a solid eccentric idler spindle 102. Idler spindle 102 can be angularly positioned to achieve the desired belt steering.

Figure 8:
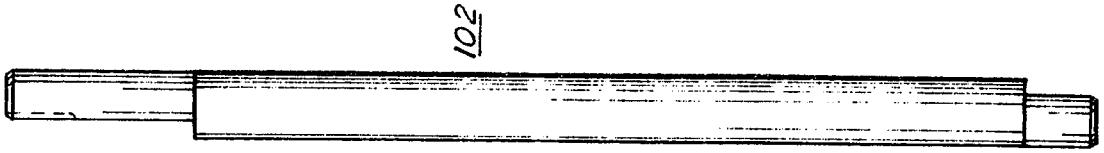
FIG. 8 is a view of the idler pulley shaft showing its eccentric construction.
Figure 8A:
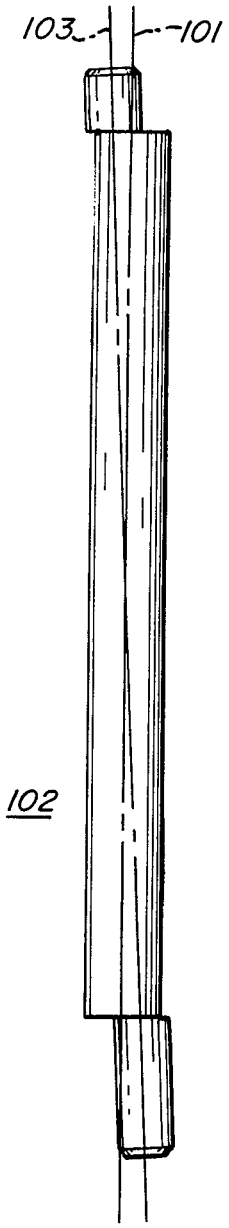
FIG. 8A is a diagrammatic enlargement, of an idler pulley shaft, with the tilt on the end portions exaggerated to more clearly show the eccentric construction.

Idler spindle 102 which can best be seen in FIGS. 8 and 8A is machined with the center offset at each end. That is, the longitudinal axis 101 of the portion of spindle 102 which supports pulley 16 is not aligned with the longitudinal axis 103 defined by the ends of spindle 102. More particularly and as best shown in FIG. 8A, spindle 102 has a circular center portion defining longitudinal axis 101 and eccentric spaced apart ends defining longitudinal axis 103 which extends transverse to longitudinal axis 101. The ends and center portion of spindle 102 are formed as a unitary part. The ends of shaft 102 lie along axis 103 and are supported by bearings for rotational movement only. As shaft 102 rotates the axis of idler pulley 16, which is aligned with idler spindle axis 101, moves with respect to contact pulley 92. Hydraulic cylinder 104 is connected by a bracket 106 to one end of idler spindle 102. The eccentric shaped spindle 102 permits precise steering of belt 12 to obtain the desired tracking by slight adjustments utilizing small hydraulic cylinder 104. By rotating slightly the end of eccentric spindle 102 a slight shift in the vertical and horizontal planes can be provided on idler pulley 16 relative to contact pulley 92 for accurate belt tracking. Cylinder 104 is activated by a photoelectric sensing system; preferably that system includes modulated, infrared, LED emitting and sensing devices (e.g. Honeywell Model FEMLS5A) which sense edgewise movement of belt 12. Photosensors 112 are attached to brackets 100 which provide outboard support for spindle 102. Photo emitters 110 are spaced apart from the photosensors 112 with the edges of the coated abrasive belt 12 passing therebetween. Photosensors 112 sense when belt 12 has moved from the desired position and actuate hydraulic cylinder 104 to shift spindle 102 in the proper direction to return belt 12 to the desired position. After spindle 102 has been shifted a slight amount a short time delay is provided which permits belt 12 to move to the desired position. After the short time delay the position of belt 12 is again sensed and if the desired position has not been reached hydraulic cylinder 104 is again activated to position belt 12. With the disclosed arrangement belt 12 can be maintained quite simply within a close tolerance to the desired position. Eccentric shaft 102 is merely adjusted by hydraulic cylinder 104 to steer the belt 12 to the desired position. The amount of eccentricity on spindle 102 is not critical and for a selected hydraulic cylinder 104 the required eccentricity would be obvious to one skilled in the art. Photoelectric emitters and sensors 110 and 112, respectively, continue moving belt 12 until it remains at the desired position. In the disclosed device the belt will move in a slow manner. Appropriate shielding means may be desirable to confined the infrared light source. It also may be desirable to provide for fluid flow over the lenses of the photoelectric devices to keep the lenses clean.

When putting on a new belt if for example it was sitting on its side in a damp area, it may tend to want to move quickly off the machine before the eccentric spindle can be properly adjusted. In this case the operater will jog the machine a little bit to allow the eccentric spindle to be automatically positioned to center the belt.

Figure 9:
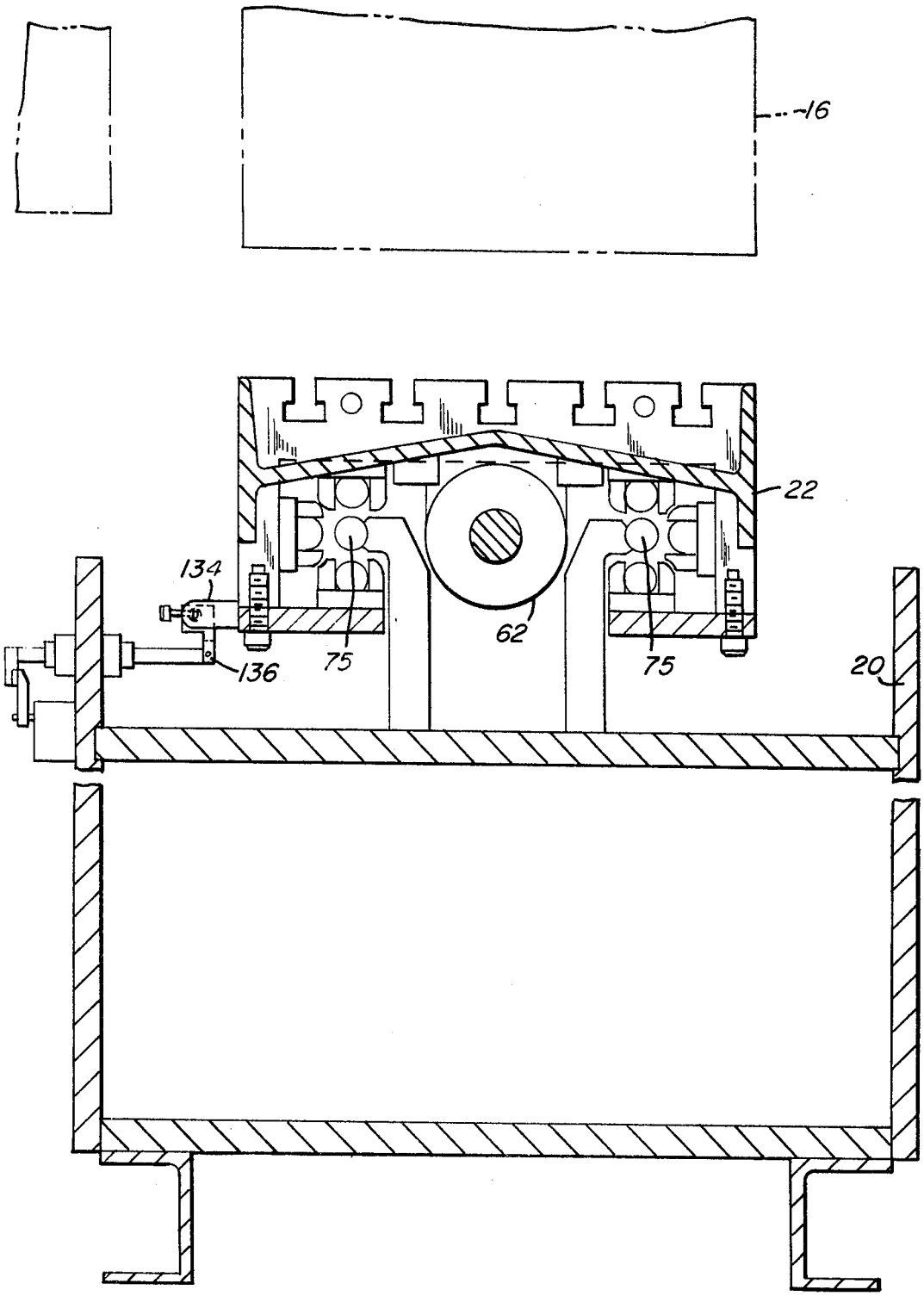
FIG. 9 is a view in FIG. 3 along the line IX—IX.

Referring now to FIG. 9 there is shown a section view through bed 20. Table 22 is supported to move on horizontally extending ground and hardened rod 75 which are supported from fixed bed 20. As contact wheel 14 is lowered by the incremental feed, it contacts the work piece which is supported on the reciprocating table 22. Hydraulic cylinder 62 reciprocates table 22. A half round slide rod 134 is provided on the side of table 22 on which are mounted actuating arms 130, 132 which are used to control the length of stroke of hydraulic cylinder 62.

Figure 11:
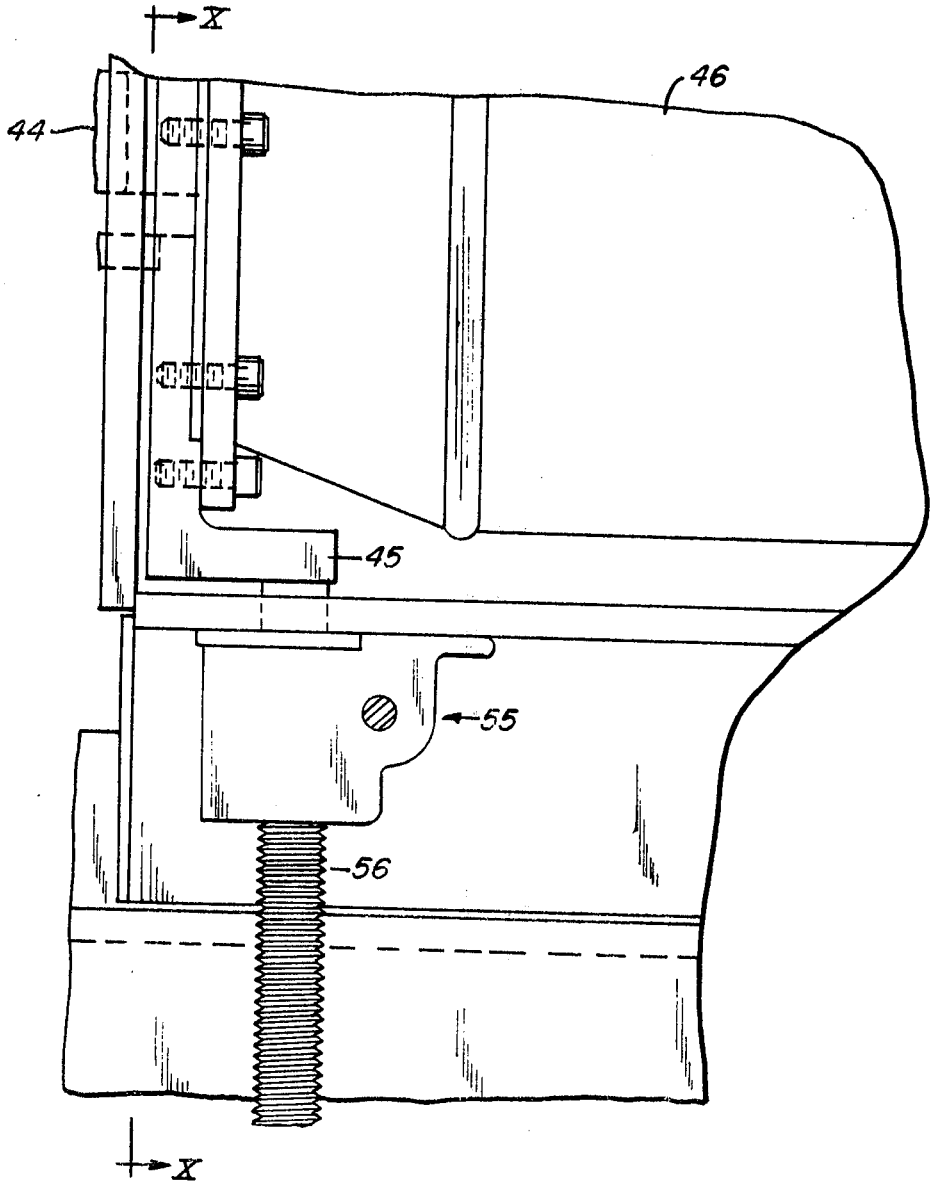
FIG. 11 is a view of a portion of the grinding machine showing the adjustable fixed stop engaging the contact wheel slide assembly.

Referring now to FIGS. 10 and 11 there is shown a more detailed illustration of the adjustable fixed stop screw 55 utilized on the disclosed belt grinding machine. The position of stop 55 can be set by the manual hand wheel 58 or the electric drive 60. The electric drive 60 has an electric starter provided in the electric panel and is used for rapid setting of stop 55. Stop 55 is provided with an 18 inch travel. By raising stop 55 above the work piece and using hydraulic cylinder 52 to bias lower slide 44 into contact with stop 55 manual controlled down feeding of the grinding head is possible. As the stop of lowered below the work piece, the grinding head will follow.

Oscillating column 40 rides on fixed rods 73. Horizontal fixed rods 73 are supported from fixed base 21. Roundway roller bearings support vertical column 40 from fixed rods 73. The electric drive 60, the manual drive operator 58 and the stop 55 move with column 40. A slotted opening is formed for receiving threaded rod 56 where it extends into base 21. The disclosed fixed stop arrangement positively limits downward movement of the grinding head. Thus if the grinding head is raised for any reason, such as to change belts 12, it will automatically return to the fixed stop position without requiring a new set up.

Figure 14:
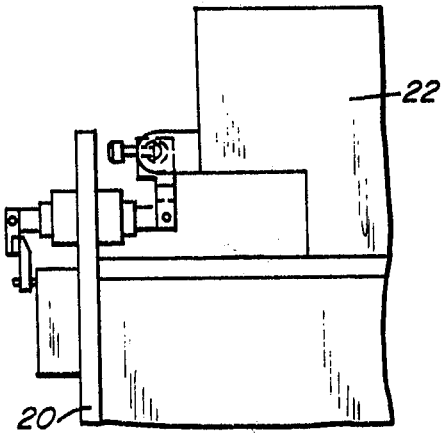
FIG. 14 is an end view of the portion of the grinding machine showing the limit switch arrangement for controlling table reciprocation.
Figure 15:
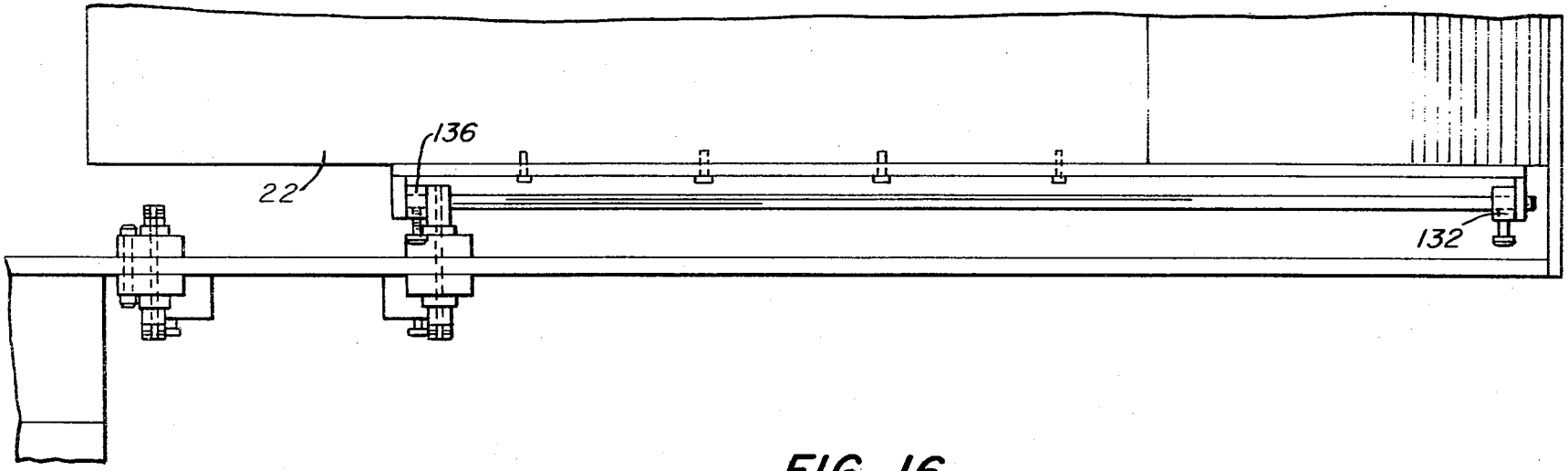
FIG. 15 is a top view of FIG. 14.
Figure 16:
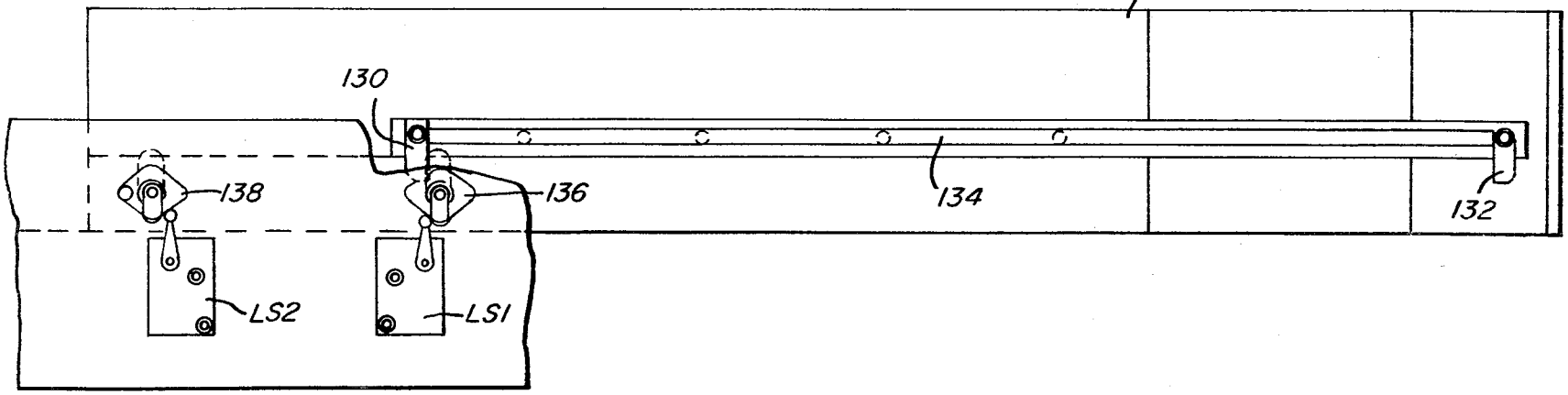
FIG. 16 is a side view of FIG. 14.

Referring now to FIGS. 14, 15 and 16 there is shown a limit switch arrangement for controlling the movement of table 22. A left hand arm 130 and a right hand arm 132 are attached to a semi-circular slide 134 which is connected for movement with table 22. The position of arms 130 and 132 on rod 134 is adjustable. Operating assemblies 136 and 138 are provided for switching limit switches LS1 and LS2 respectively. Arm 132 turns operating assembly 138 to switch limit switch LS2 and arm 130 turns operating assembly 136 to switch limit switch LS1. Arm 130 is offset to bypass operating assembly 138 as table 22 moves and arm 132 is offset to bypass operating assembly 136 as table 22 moves. When arm 132 contacts operating assembly 138 limit switch LS2 is operated and four way valve 126 connected to cylinder 62 is operated to reverse the direction of hydraulic cylinder 62 which controls movement of table 22.

Figure 12:
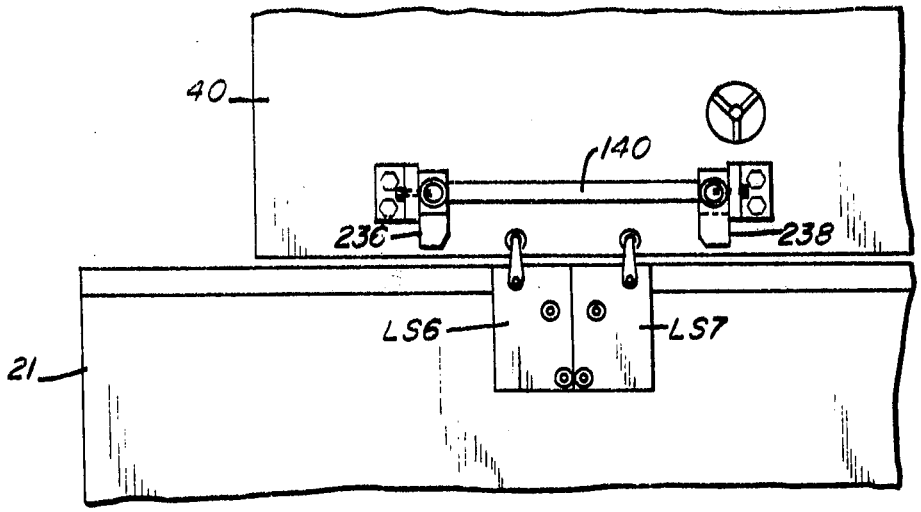
FIG. 12 is a side view of a portion of the grinding machine showing the limit switch arrangement for controlling column oscillation.
Figure 13:
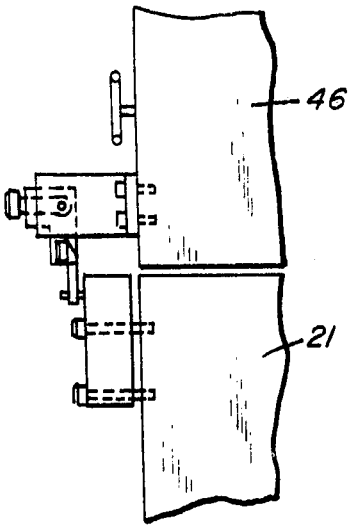
FIG. 13 is an end view of FIG. 12.

The oscillation of column 40 is controlled by a similar limit switch and arm arrangement as shown in FIGS. 12 and 13. As shown in FIGS. 12 and 13 arms 236 and 238 are provided on a slide 140 which is attached to oscillating column 40. Arm 236 activates limit switch LS7 and arm 238 activates limit switch LS6 to control the distance of oscillation of column 40. Arms 236 and 238 can be positioned as desired along slide 140.

Figure 17:
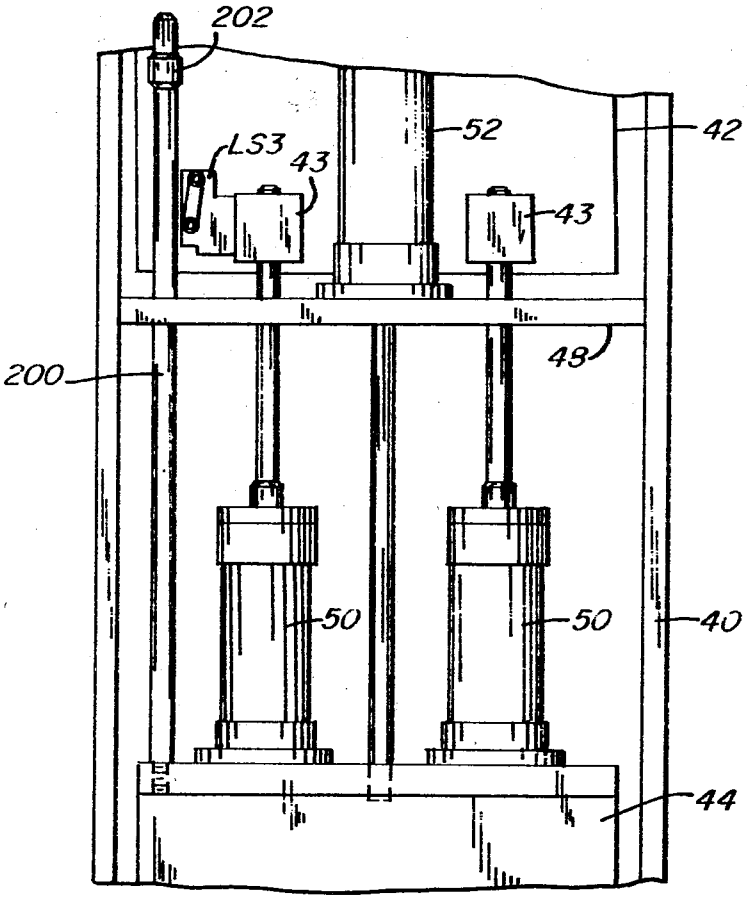
FIG. 17 is a rear view of the vertical column with some portions removed for clarity showing the limit switch which senses belt tear.

FIG. 17 shows the position of a limit switch LS3 which when activated cause lower slide 44 to raise up. As pointed out previously air cylinders 50 bias slides 42 and 44 apart. Hydraulic cylinder 52 moves lower slide 44. An operating rod 200 is connected to lower slide 44 with an actuator 202 positioned thereon. Actuator 202 is disposed to activate a limit switch LS3 if slides 42 and 44 separate by more than a predetermined distance. Actuator 202 is positionable on rod 200 and is set to activate limit switch LS3 at a separation which could only be achieved when belt 12 breaks. Limit switch LS3 when activated controls the four way valve 126 connected to cylinder 52 to raise lower slide 44. Limit switch LS3 is electrically connected to override the various other limit switches so as to immediately raise the grinding head when activated. Lower slide 44 which supports contact wheel 14 is thus automatically raised when belt 12 breaks.

Figure 18:
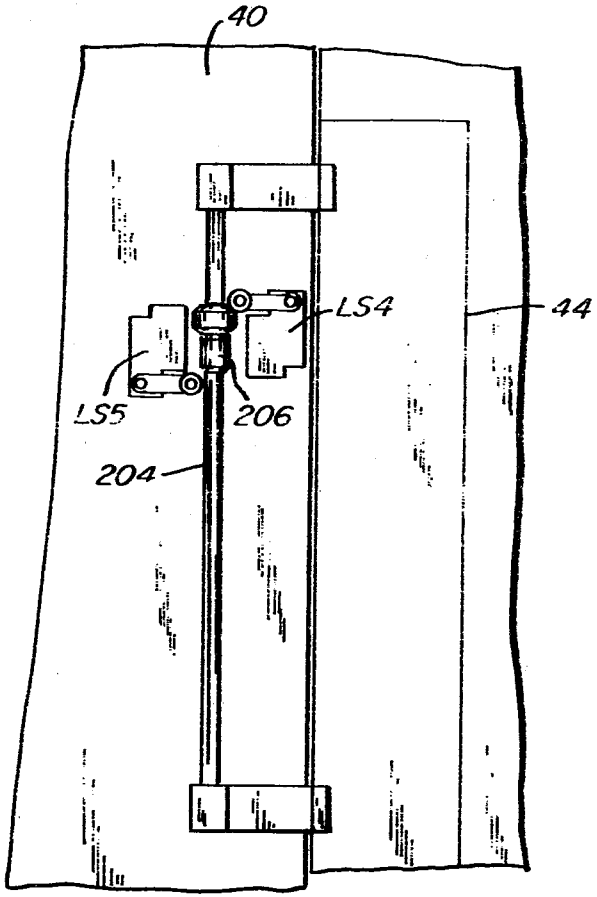
FIG. 18 is a view of a portion of the vertical column and lower slide showing the final pass limit switch and the head positioning limit switch; and, FIG. 19 is a schematic of the hydraulic system utilized on the disclosed belt grinding machine.

FIG. 18 shows the arrangement of two limit switches LS4 and LS5 which are utilized on grinder 10. Limit switches LS4 and LS5 are positionable on column 40. A rod 204 having an actuator 206 is connected for movement with lower slide 44 and is disposed between limit switches LS4 and LS5. Limit switch LS5 is set to be activated when lower slide 44 contacts stop 55. When limit switch LS5 is activated, through appropriate electrical interfacing, it causes table 22 to reciprocate for a final pass and then raises the grinding head. The grinding head raises until actuator 206 activates limit switch LS4. Limit switch LS4, through appropriate interfacings, then limits upward movement of lower slide 44. Limit switch LS4 is set at a height slightly above the height of the rough work piece. Thus, the required movement of the operating rod for cylinder 52 is kept to a minimum.

Figure 19:
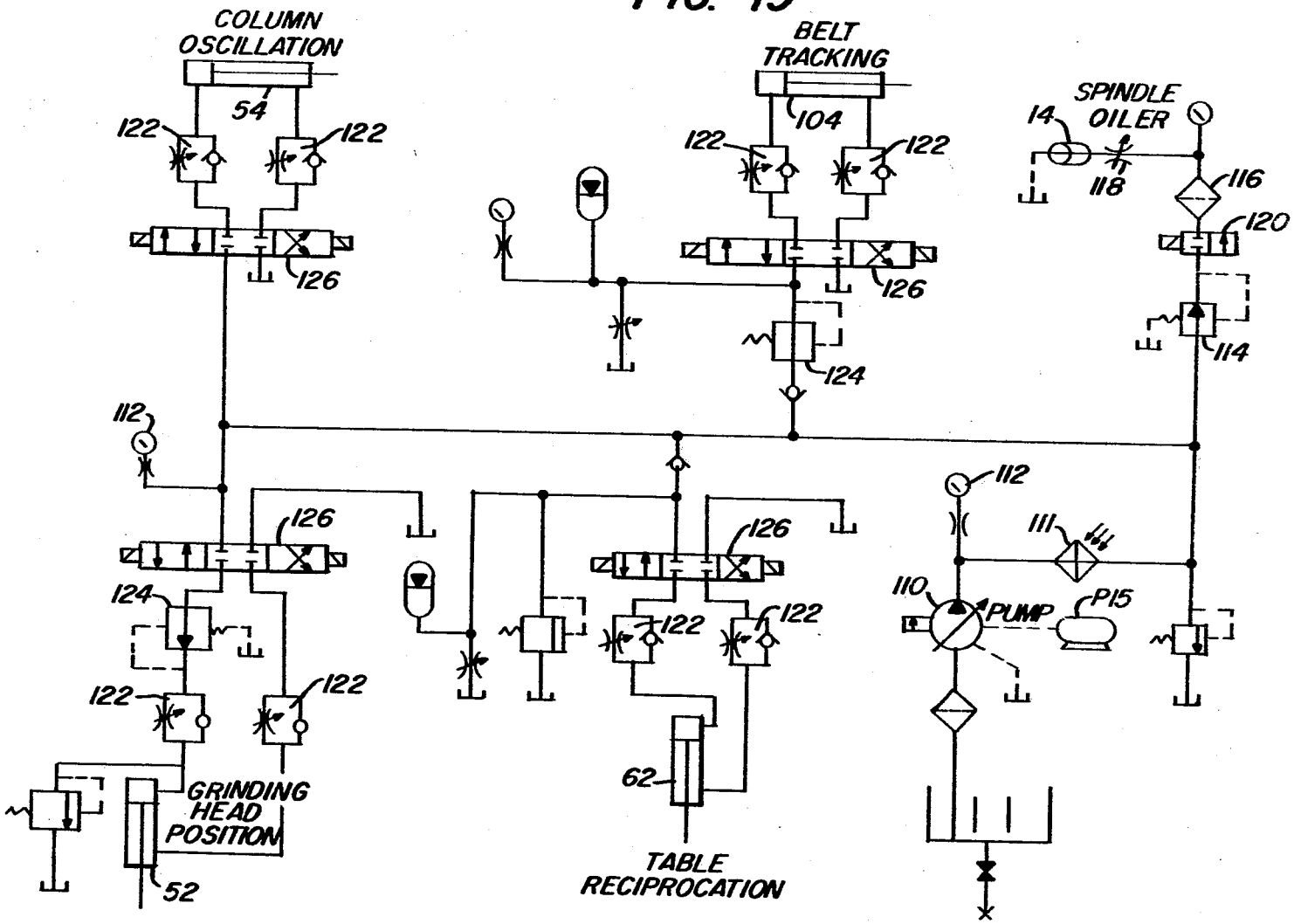

Referring now to FIG. 19 there is shown a hydraulic schematic for the hydraulic system utilized on belt grinder 10. Pump 110 is driven by a 15 horse power motor P15 and supplies hydraulic fluid, at a pressure of approximately 1000 psi, for operating the various hydraulic cylinders and cooling contact wheel bearings 84. A heat exchanger 111 can be provided for cooling the hydraulic fluid if desired. Pressure gauges 112 are provided for indicating the supply line pressure. A pressure reducer 114 and a filter 116 are provided in the hydraulic supply lines to the contact wheel assembly 14. A flow control valve 118 is provided for regulating the amount of oil fed to the contact wheel spindle 74 for cooling bearings 84. An electrically operated two way valve 120 is provided for turning on and off the hydraulic fluid flow to the contact wheel spindle 74.

Adjustable flow control valves with a bypass 122 are provided in the hydraulic lines which feed pressurized fluid to either side of the double acting hydraulic cylinders 52, 54, 62 or 104, to control the speed of operation in either directon. The flow control valves 122 provided in the lines to the grinding head positioning cylinder 52 are set to raise the grinding head fast and to bring it down slowly. A pressure reducing valve 124 is also provided in the hydraulic line feeding the down port of hydraulic cylinder 52. Pressure reducing valve 124 controls the downstroke pressure of cylinder 52 so that the grinding head will ride up if motor 46 approaches a stall condition. That is, the pressure of pressuring reducing valve 124 is set so that the drive motor will not be overloaded if the amount of material attempted to be removed is too great. A four way three position valve 126 is connected in the lines feeding cylinder 52 to either raise or lower the grinding head assembly. Grinding head valve 126 connects either the up or down port of hydraulic cylinder 52 to the hydraulic supply and connects the other port to the hydraulic reservoir.

The four way three position valve 126 connected in the hydraulic lines to cylinder 62 controls the direction of table 22. The four way three position valve 126 connected in the hydraulic lines to cylinder 54 controls the direction of the oscillating vertical column 40. The four way valve 126 connected to the tracking cylinder 104 controls the direction of tracking cylinder 104. A pressure regulator 124 is provided in the hydraulic supply line to tracking cylinder 104 to reduce pressure and improve control.

All of the control valves 126 are electrically operated. The energizing of the various solenoids which operate valves 126 is controlled by various limit switches which are positioned to obtain the desired operation.

The electrical controls are enclosed in a freestanding NEMA panel box (not shown) approximately 36 inches wide×60 inches high. A control panel (not shown) which includes a 25 hole push button station and machine disconnect is mounted on a pedestal from base 21. The freestanding panel also houses across line starters for the main drive motor 46, the hydraulic pump motor P15, and the rapid traverse motor 60. A push button is provided for turning on control power and this is indicated by a white pilot light. A digital read out is provided for indicating the position of the grinding head. Push buttons are provided for energizing the starters for the various electric motors. An ammeter is provided on one of the lines feeding drive motor 46 to indicate the current being drawn. A push button is provided for initiating reciprocation of table 22. Table 22 continues reciprocating until lower slide 44 contacts stop 55 at which point a limit switch is closed and table 22 is reciprocated for one final pass. After the final pass the grinding head is raised to a selected position. The finished work piece can then be removed and a new one inserted and the cycle repeated.

The grinding head assembly is enclosed in a steel covered bottomless enclosure having a door which can be remotely locked. The disclosed coated abrasive belt grinding machine has numerous advantages over prior art machines such as column oscillation for uniform belt wear, variable speed reciprocating table, elimination of outboard supports for the contact wheel, fast belt and contact wheel change, automatic grinding head lifting in the event of belt breakage, simplified and accurate tracking, and an operating control panel which is located to the side of the column away from grinding swarf. The modular construction lends itself to extending and widening the table and bed, utilizing multiple heads for roughing and finishing in single pass operations, and conveyor or roller feed to minimize material handling. The incremental feed mechanism is an integral part of the machine and is used to set and control the downfeed of the grinding belt head between passes of the reciprocating table.

Each time table 22 reciprocates limit switch LS2 is switched. Limit switch LS2 then activates an adjustable timer which energizes three way valve 126 feeding cylinder 52 to move cylinder 52 towards the extended position for a set period of time. This is repeated each time table 22 reciprocates. The grinding head is thus fed down in adjustable steps.

The disclosed coated abrasive grinding machine provides a high speed, high pressure stock removal system which utilizes the endless coated abrasive belt 12 to grind planar surfaces of various materials. Typical belt speeds of 8000 surface feet per minute coupled with the feed rates of 25 to 40 feet per minute generate temperatures in the contact area which approach the melting point of the material being abraded. This condition aides the machining process by reducing friction and correspondingly increases belt life. Heat built up in the work piece is minimal because over 90% of the energy generated is removed by the swarf. Metal removal rates of the disclosed machine will approach 60 cubic inches of cast iron per minute per square inch of contact surface area between the contact wheel and the work piece. The horsepower requirements in a sustained metal removal operation are about 2 horsepower per cubic inch per minute. Motor 46 can be thus sized for the desired removal rate. The disclosed machine offers users production rates which are substantially faster than milling or planing. Additionally, the relatively low cost of coated abrasive belts as compared with carbide bits or grinding wheels gives the disclosed machine a tool cost advantage. Down time for belt changing is very small.

The disclosed belt grinder 10 can be used in a great variety of industries. Foundries can use the belt grinding machine for gate and riser removal and surface qualification. Casting and forging plans can use belt grinding machining 10 for surface machining such items as pumps, valves, engine blocks, transmission housings, manifolds, clutch plates and the like. Tool and die makers can use grinding machine 10 for dimensioning of bar stock, molded base machining, and die surfacing and resurfacing. Fabricators can use grinding machine 10 for weld bead removal and surface machining. Prime metal industries such as steel can use the disclosed grinding maching for billet conditioning, billet test piece machining and finishing. Refractories can use the grinding machine for refractory block dimensioning, slide gate machining, and die resufacing. The vitreous china industry can use the disclosed grinding machine for surface grinding on such items as toilet bowl foot or stall urinals. The glass industry can use the disclosed grinding machine for edge and surface grinding on items such as windshields, and plate mirror blanks. Cement block makers can use grinding machine 10 for block dimensioning and facing. The carbon industry can use the disclosed grinding machine for graphite block dimensioning and anode grinding. Industries which use flame cutters and parts users can use grinding machine 10 for clean up of slag.

What is claimed is:

1. A belt grinding machine, for grinding a workpiece, comprising:

an elongated fixed bed;

a table for receiving the workpiece supported for back and forth movement along said elongated fixed bed;

power means for providing continuous oscillating back and forth movement to said table while grinding the workpiece;

a base secured to said bed and extending therefrom transverse to the longitudinal axis of said bed;

a vertical column supported from said base for back and forth movement transverse to the movement of said table;

power means for providing continuous reciprocating back and forth movement to said vertical column along said base normal to the longitudinal axis of the bed while grinding the workpiece;

a contact wheel slidably supported for up and down movement on said vertical column;

an idler wheel slidably supported on said vertical column, above said contact wheel, for up and down movement on said column;

a grinding belt which is wider than the workpiece disposed around said contact wheel and said idler wheel above said table for back and forth movement with said column while grinding;

table speed control means which is adjustable for controlling the speed of oscillation of said table;

table travel control means which is adjustable for controlling the travel of said table;

column speed control means which is adjustable for controlling the speed at which said column reciprocates; and column travel control means which is adjustable for controlling the travel of said column which moves said grinding belt back and forth over the workpiece when grinding.

2. A belt grinding machine as claimed in claim 1 wherein:

said table oscillating means comprises a hydraulic cylinder; and, said column reciprocating means comprises a hydraulic cylinder.

3. A belt grinding machine as claimed in claim 1 or 2 comprising:

belt positioning means for maintaining said belt at a desired position on said idler wheel and said contact wheel.

4. A belt grinding machine as claimed in claim 3 wherein said belt positioning means comprises:

an eccentric shaft;

bearing means supporting said idler wheel from said eccentric shaft;

shaft positioning means for rotating said eccentric shaft to tilt said idler wheel;

means for sensing the position of said belt; and, control means operating in response to said sensing means for positioning said eccentric shaft to maintain said grinding belt at a desired position.

5. A belt grinding machine as claimed in claim 4 wherein:

said shaft positioning means comprises a hydraulic cylinder.

6. A belt grinding machine as claimed in claim 1 comprising:

a drive motor directly connected to said contact wheel.

7. A belt grinding machine comprising:

an elongated fixed bed;

a vertical column supported for reciprocating movement along an axis transverse to the longitudinal axis of said elongated fixed bed;

column reciprocating means for continuously reciprocating said vertical column back and forth;

an idler pulley supported from said column and slidable thereon;

a contact pulley supported from said column, spaced apart from said idler pulley, and slidable on said column;

a continuous belt having coated abrasive on the outside thereof disposed around said idler pulley and said contact pulley;

tensioning means for biasing said idler pulley and said contact pulley apart to put tension on said belt;

a table supported on said elongated bed for movement parallel to the longitudinal axis of said bed;

table reciprocating means for reciprocating said table beneath the contact pulley which is supported from said vertical column;

feed means for moving said contact wheel toward said table;

a spindle having a circular center portion defining a first longitudinal axis and eccentric spaced apart ends defining a second longitudinal axis extending transverse to the first longitudinal axis;

bearing means supporting said idler pulley from the circular center portion of said spindle for rotation thereabout;

adjusting means disposed on said column for supporting and rotatably positioning the eccentric ends of said spindle to adjust the tilt of the first longitudinal axis, which is defined by the circular center portion, relative to said column;

photoelectric sensing means for sensing the position of said belt, and, control means responsive to said photoelectric sensing means for controlling said adjusting means to rotate the position of the eccentric ends of said spindle to maintain said belt at a desired position.

8. A belt grinding machine as claimed in claim 7 wherein:

said idler pulley is offset and not in vertical alignment relative to said contact pulley.

9. A belt grinding machine as claimed in claim 7 comprising:

table control means operably associated with said table reciprocating means for controlling the speed of reciprocation and travel of said table and being adjustable; and, column control means operably associated with said column reciprocating means for controlling the speed of reciprocation and travel of said column and being adjustable.

10. A material removing machine for removing material from the flat surface of an article comprising:

an elongated bed;

means for supporting the article from the elongated bed;

a vertical column movable along an axis transverse to the longitudinal axis of said bed;

means for moving said column back and forth;

a drive pulley supported from said column above the article;

drive means for driving said drive pulley directly connected to said drive pulley and supported by said column;

an idler pulley disposed above said drive pulley;

a coated abrasive belt which is wider than the width of the article to be ground disposed around said drive pulley and said idler pulley;

a spindle comprising a circular center portion defining a first longitudinal axis and eccentric spaced apart ends defining a second longitudinal axis extending transverse to the first longitudinal axis;

bearing means supporting said idler pulley from the circular center portion of said spindle for free rotation therearound;

support means for supporting the eccentric ends of said spindle from said column;

adjusting means for rotating the eccentric ends of said spindle to various positions to change the alignment of the circular center portion of said spindle relative to said column;

photoelectric sensing means for sensing the position of said belt; and, control means responsive to said photoelectric sensing means for controlling said adjusting means to rotate the eccentric ends of said spindle to a position which maintains said belt at a set position.

11. A material removing machine as claimed in claim 10 comprising:

limit switch means which are adjustable for setting the distance which said vertical column moves.

12. A material removing machine as claimed in claim 10 comprising:

rate adjusting means for adjusting the rate at which said vertical column moves.

* * * * *

UNITED STATES PATENT AND TRADEMARK OFFICE

CERTIFICATE OF CORRECTION

PATENT NO. : 4,267,671

DATED : May 19, 1981

INVENTOR(S) : Richard Rettew

It is certified that error appears in the above-identified patent and that said Letters Patent are hereby corrected as shown below:

Col. 3, line 63, delete "tear" and substitute therefor --wear--;

Col. 6, line 22, delete "grid-" and substitute therefor -- grind- --;

Col. 9, line 25, delete "of" and substitute therefor --is--;

Col. 12, line 36, delete "resufacing" and substitute therefor --resurfacing--; and Col. 14, line 19, delete "belt," and substitute therefor --belt;--.

Signed and Sealed this

Sixth Day of October 1981

[SEAL]

*Attest:*

GERALD J. MOSSINGHOFF

*Attesting Officer*

*Commissioner of Patents and Trademarks*